US005619978A

United States Patent [19]

Flournoy

[11] Patent Number: 5,619,978

[45] Date of Patent: Apr. 15, 1997

[54] SLINGSHOT

[76] Inventor: Jerry Flournoy, HC 2, Box 77N, Spicewood, Tex. 78669

[21] Appl. No.: 645,506

[22] Filed: May 14, 1996

[51] Int. Cl.[6] ..... F41B 3/02

[52] U.S. Cl. ..... 124/20.1; D22/106

[58] Field of Search ..... 124/20.1, 20.3; D22/106

[56] References Cited

U.S. PATENT DOCUMENTS

| | | | |
|---|---|---|---|
| D. 352,086 | 11/1994 | Ott | D22/106 |
| 1,606,609 | 11/1926 | Wheeler | 124/20.1 |
| 3,865,094 | 2/1975 | Sweeney | 124/20.1 |
| 3,875,923 | 4/1975 | Horel | 124/20.1 |
| 3,918,427 | 11/1975 | Turner | 124/20.1 |
| 3,974,820 | 8/1976 | Ott | 124/20.1 |
| 4,050,438 | 9/1977 | Pfotenhauer | 124/20.1 |
| 4,852,543 | 8/1989 | Mosser | 124/20.1 |
| 5,016,601 | 5/1991 | Ferguson et al. | 124/20.1 |
| 5,072,715 | 12/1991 | Barr | 124/20.1 |

*Primary Examiner*—John A. Ricci
*Attorney, Agent, or Firm*—Stephen R. Greiner

[57] ABSTRACT

An improved projectile launching weapon or slingshot. The slingshot is provided with a rigid frame having a projectile launching portion to which is secured a forearm supporting portion. The projectile launching portion includes a first elongated member having a forward end and a rearward end. To the forward end of the first elongated member is secured a fork adapted for the attachment of elastomeric tubes. A crossmember is secured to the rearward end of the first elongated member and includes a terminal end defining a handgrip. A forearm supporting portion is secured to the crossmember between the terminal end thereof and the first elongated member.

18 Claims, 1 Drawing Sheet

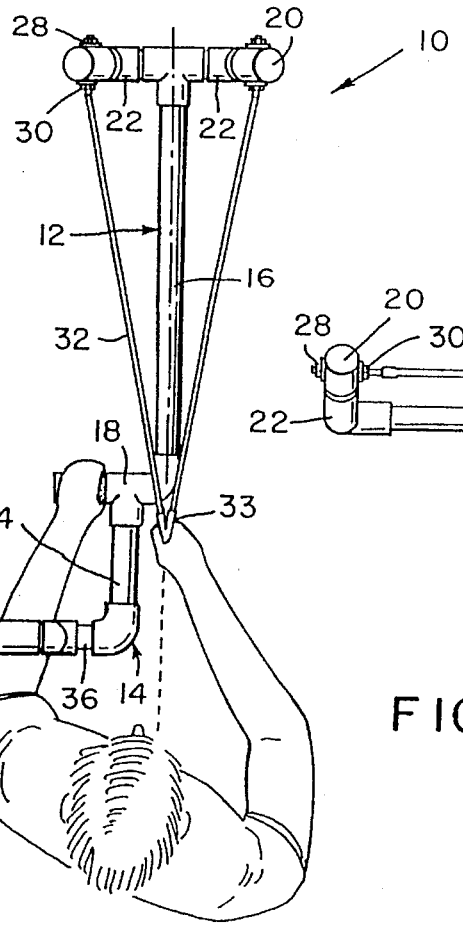
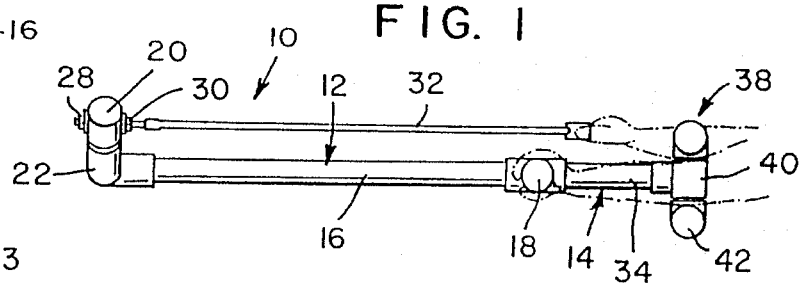
FIG. 1
FIG. 2
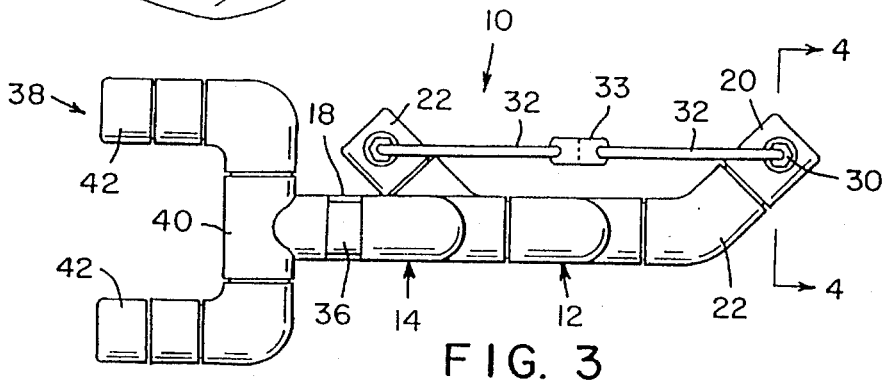
FIG. 3
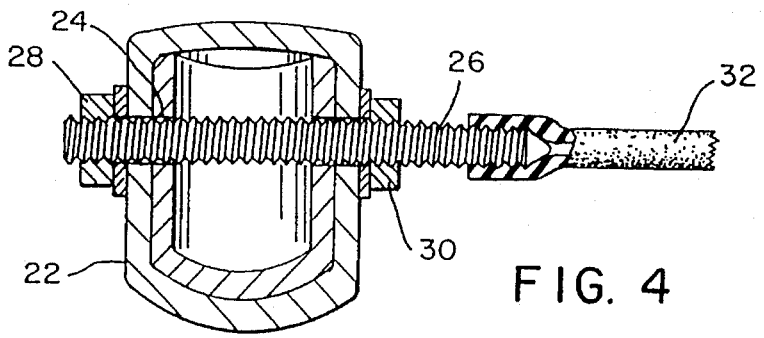
FIG. 4

SLINGSHOT

FIELD OF THE INVENTION

The present invention relates generally to mechanical projectile launchers utilizing elastic bands

BACKGROUND OF THE INVENTION

A conventional slingshot includes a handle having a pair of arms connected to its upper end in the form of a "Y". To the free ends of the arms are secured a pair of elastic members having at their center a small piece of suede or the like for releasably holding a projectile. Because the strain imparted to the hand and wrist of a user when stretching the elastic members can be excessive, forearm supports are now often joined to the bottom of the handle. Such supports extend rearwardly from the handle to cradle the forearm of the user at a location remote from the hand grasping the slingshot handle.

The human anatomy has, unfortunately, made it difficult for a user of a conventional slingshot to aim such with great precision. Aligning the human head with any slingshot component in the same manner that a firearm would be accurately sighted along its barrel has, heretofore, been all but impossible. Therefore, a need exists for a slingshot that may be aimed with more precision than that offered by available devices.

SUMMARY OF THE INVENTION

In light of deficiencies presented by the slingshots currently available in the marketplace, it is a principal object of the invention to provide a slingshot which may be aimed in a manner similar to that of a rifle or shotgun by sighting directly along the longitudinal axis of one of its members so that projectiles may be thrown therefrom with great velocity, accuracy and ease.

It is a further object of the invention to provide a slingshot of the type described with means for adjusting the positioning of the elastomeric members or tubes used in launching a projectile so as to suit the physical requirements of a particular user.

It is another object of the invention to provide a slingshot of the type described wherein reactive forces caused by stretching of the elastomeric tubes are transmitted to an upper forearm of a user for stability during aiming.

It is an object of the invention to provide improved elements and arrangements thereof in a slingshot which is lightweight, inexpensive, dependable and fully effective in accomplishing its intended objects.

Briefly, the slingshot in accordance with this invention achieves the intended objects by featuring a projectile launching portion including a first elongated member having a forward end and a rearward end. A fork, adapted for the attachment of a pair of elastomeric tubes, is secured to the forward end of the first elongated member. A crossmember is secured to the rearward end of the first elongated member and has a terminal end remote therefrom defining a handgrip. Secured to the crossmember between its terminal end and the first elongated member is a forearm supporting portion.

The foregoing and other objects, features and advantages of the present invention will become readily apparent upon further review of the following detailed description of the preferred embodiment, as illustrated in the accompanying drawings.

BRIEF DESCRIPTION OF THE DRAWINGS

The present invention may be more readily described with reference to the accompanying drawings, in which:

FIG. 1 is a side elevational view of a slingshot in accordance with the present invention.

FIG. 2 is a top plan view of the slingshot of FIG. 1.

FIG. 3 is a rear elevational view of the slingshot.

FIG. 4 is a cross sectional view taken along line 4—4 of FIG. 3.

Similar reference characters denote corresponding features consistently throughout the accompanying drawings.

DETAILED DESCRIPTION OF THE PREFERRED EMBODIMENT

Referring now to the FIGS., a slingshot in accordance with the present invention is shown at 10. The slingshot 10 includes a rigid frame comprising a projectile launching portion 12 and a forearm supporting portion 14 extending rearwardly therefrom. In the preferred embodiment, the frame is assembled from a plurality of hollow, tubular elements each formed of PVC and secured together with a suitable adhesive. Nonetheless, it is contemplated that the frame may be formed from any suitable material including, but not limited to, graphite-composite and aluminum tubing or rod stock. The frame may also be integrally molded from a thermoplastic or other composition if desired.

As shown, the projectile launching portion 12 includes a forward elongated member 16 having a crossmember 18 secured to its rearward end and a generally U-shaped fork 20 secured to its forward end. Preferably, the crossmember 18 extends at a right angle from the forward elongated member 16 to a terminal end defining a handgrip which may be padded for user comfort. The respective longitudinal axes of the crossmember and forward elongated member define a first plane in space. The fork 20, on the other hand, is provided with a pair of opposed arms 22 whose axes are positioned in a second plane normal to the longitudinal axis of the forward elongated member 16. The terminal ends of the arms 22 are preferably directed upwardly at an angle of 45 degrees from said first plane.

The terminal end of each of the arms 22 is provided with a transverse bore 24 whose central axis is parallel to the longitudinal axis of the forward elongated member 16. Fitted within each transverse bore 24 is a threaded rod 26 sized to project from the opposite sides of each arm 22. Nuts 28 and 30 are threadably fastened to each rod 26 and permit its rearward projection to be selectively varied as a user may desire.

To the rearward projections of the rods 26 are frictionally fitted two equal lengths of elastomeric tubing 32 joined together by a projectile carrying pouch 33 in the conventional manner. As shown in FIG. 4, the rods 26 are provided with a somewhat greater outside diameter than the inside diameter of the elastomeric tubing 32. Thus, when drawing the tubing 32 away from the rods 26, its inside diameter may be further reduced causing the tubing to more securely grip the rods.

The forearm supporting portion 14 is provided with a rearward elongated member 34 secured to the crossmember 18 and extending rearwardly therefrom. Preferably, the longitudinal axis of the rearward elongated member 34 is parallel to that of the forward elongated member 16 and is positioned in the first plane described hereinabove. Extending at a right angle from the remote end of the rearward elongated member 34 is a lateral spacer member 36 having a longitudinal axis in the first plane and a distal end positioned substantially opposite that of the crossmember 18.

In the preferred embodiment, a forearm engaging cradle 38 is carried at the distal end of the spacer member. As illustrated, the cradle 38 comprises a pressure distributing member 40, secured at its midpoint to the spacer member 36, and a pair of spaced stabilizer arms 42 extending laterally from the pressure distributing member. The stabilizer arms 42 are positioned opposite one another to snugly receive the forearm of a user therebetween. The respective longitudinal axes of the arms 42 preferably fall within a third plane parallel to the second plane described hereinabove containing the axes of arms 22.

While the invention has been described with a high degree of particularity, it will be appreciated by those skilled in the art that numerous modifications and substitutions may be made thereto. For instance, a forearm encircling strap, having a releasable fastener such as a buckle or hook-and-loop type closure along its length, may be readily substituted for the forearm engaging cradle 38. Such a strap would not only assist in stabilizing a slingshot so equipped during use, but would permit such to be carried without effort by a user when said strap was securely fastened. Therefore, it is to be understood that the present invention is not limited to the sole embodiment described above, but encompasses any and all embodiments within the scope of the following claims.

I claim:

1. A slingshot, comprising:

a projectile launching portion including:

a first elongated member having a forward end and a rearward end;

a fork secured to the forward end of said first elongated member, said fork adapted for attachment of elastomeric tubes;

a crossmember secured to the rearward end of said first elongated member and having a terminal end remote therefrom defining a handgrip; and, a forearm supporting portion secured to said crossmember, between said first elongated member and said terminal end, and extending rearwardly therefrom.

2. The slingshot according to claim 1 wherein said forearm supporting portion includes:

a second elongated member secured to said crossmember; and, a forearm engaging cradle secured to said second elongated member.

3. The slingshot according to claim 2 wherein said first elongated member, said second elongated member and said crossmember each include distinct longitudinal axes, said axes all disposed within a single plane.

4. The slingshot according to claim 3 wherein the respective longitudinal axes of said first elongated member and said second elongated member are disposed parallel to one another.

5. The slingshot according to claim 2 wherein the respective longitudinal axes of said first elongated member and said second elongated member are disposed parallel to one another.

6. The slingshot according to claim 1 wherein said projectile launching portion and said forearm supporting portion both comprise a plurality of hollow tubular elements.

7. The slingshot according to claim 1 wherein said fork includes:

a pair of opposed arms extending from said first elongated member; and, a threaded rod threadably secured to each of said opposed arms and extending rearwardly therefrom, each said rod adapted to be secured to an elastomeric tube.

8. A slingshot, comprising:

a first elongated member having a forward end, a rearward end and a longitudinal axis intersecting said forward and rearward ends;

a fork secured to the forward end of said first elongated member, said fork adapted for attachment of elastomeric tubes;

a crossmember secured to the rearward end of said first elongated member and having a terminal end remote therefrom defining a handgrip, said crossmember further having a longitudinal axis; and, a second elongated member secured to said crossmember between said first elongated member and said terminal end, said second elongated member having a longitudinal axis parallel to that of said first elongated member; and, a forearm engaging cradle secured to said second elongated member.

9. The slingshot according to claim 8 wherein the respective longitudinal axes of said first elongated member, said second elongated member and said crossmember are all disposed within a single plane.

10. The slingshot according to claim 8 comprising a plurality of hollow tubular elements.

11. The slingshot according to claim 8 wherein said fork includes:

a pair of opposed arms extending from said first elongated member; and, a threaded rod threadably secured to each of said opposed arm and extending rearwardly therefrom, said rod adapted for securing an elastomeric tube.

12. A slingshot, comprising:

a projectile launching portion including:

a first elongated member having a forward end and rearward end;

a fork secured to the forward end of said first elongated member, said fork adapted for attachment of elastomeric tubes; and, a crossmember perpendicularly secured to the rearward end of said first elongated member and having a terminal end remote therefrom defining a handgrip; and, a forearm supporting portion perpendicularly secured to said crossmember, between said first elongated member and said terminal end, and extending rearwardly therefrom.

13. The slingshot according to claim 12 wherein said forearm supporting portion includes:

a second elongated member secured to said crossmember; and, a forearm engaging cradle secured to said second elongated member.

14. The slingshot according to claim 13 wherein said first elongated member, said second elongated member and said crossmember each include distinct longitudinal axes, said axes all disposed within a single plane.

15. The slingshot according to claim 13 wherein said first elongated member and said second elongated member each include distinct longitudinal axes, said longitudinal axes being disposed parallel to one another.

16. The slingshot according to claim 12 wherein said first elongated member and said second elongated member each include distinct longitudinal axes, said longitudinal axes being disposed parallel to one another.

17. The slingshot according to claim 12 wherein said projectile launching portion and said forearm supporting portion both comprise a plurality of hollow tubular elements.

18. The slingshot according to claim 12 wherein said fork includes:

a pair of opposed arms extending from said first elongated member; and, a threaded rod threadably secured to each of said opposed arms and extending rearwardly therefrom, said rod adapted for snug positioning within an elastomeric tube.

* * * * *